US011118254B2

(12) United States Patent
Xu et al.

(10) Patent No.: US 11,118,254 B2
(45) Date of Patent: Sep. 14, 2021

(54) THERMAL TREATMENT METHOD FOR ALUMINUM ALLOY CAST-SPUN WHEEL

(71) Applicant: CITIC Dicastal CO., LTD., Hebei (CN)

(72) Inventors: Zuo Xu, Qinhuangdao (CN); Guoyuan Xiong, Qinhuangdao (CN); Honglei Liu, Qinhuangdao (CN); Hongfeng Liu, Qinhuangdao (CN); Rui Wang, Qinhuangdao (CN); Changhai Li, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 226 days.

(21) Appl. No.: 16/127,581

(22) Filed: Sep. 11, 2018

(65) Prior Publication Data

US 2019/0078185 A1 Mar. 14, 2019

(30) Foreign Application Priority Data

Sep. 13, 2017 (CN) ..... 201710822431.X

(51) Int. Cl.
*C22F 1/04* (2006.01)
*C22F 1/00* (2006.01)

(52) U.S. Cl.
CPC ..... *C22F 1/04* (2013.01); *C22F 1/002* (2013.01)

(58) Field of Classification Search
None
See application file for complete search history.

(56) References Cited

U.S. PATENT DOCUMENTS 8,721,811 B2 * 5/2014 Lin ..... B22D 25/06 148/700
2005/0000608 A1 * 1/2005 Ogris ..... C22F 1/043 148/698
2005/0100473 A1 * 5/2005 Ikuno ..... C22F 1/043 420/534
2010/0288401 A1 * 11/2010 Hennings ..... C22C 21/02 148/549
2015/0252460 A1 * 9/2015 Lisheng ..... C22F 1/04 148/537
2018/0127859 A1 * 5/2018 Hu ..... C22C 21/02
2019/0118251 A1 * 4/2019 Hu ..... B22D 21/007

FOREIGN PATENT DOCUMENTS

CN 104975161 A 10/2015
CN 105543739 A 5/2016
CN 106884129 A 6/2017

OTHER PUBLICATIONS

Espacenet machine translation of CN 104975161 (Year: 2020).*
"Heat Treating of Aluminum Alloys", ASM Handbook, vol. 4: Heat Treating, ASM Handbook Committee, p. 841-879, DOI: 10.1361/asmhba0001205 (Year: 1991).*

* cited by examiner

*Primary Examiner* — Stefanie J Cohen
*Assistant Examiner* — Christopher D. Moody
(74) *Attorney, Agent, or Firm* — Cooper Legal Group, LLC

(57) ABSTRACT

A thermal treatment method for an A356 aluminum alloy cast-spun wheel is provided. The thermal treatment method is characterized by including the steps of: 1) heating an aluminum alloy wheel cast-spun piece to 540-550° C.; 2) preserving the heat of the aluminum alloy wheel cast-spun piece for 275-285 minutes at the temperature of 540-550° C.; 3) quenching the aluminum alloy wheel cast-spun piece in water of 70-90° C. for 180 seconds; 4) heating the aluminum alloy wheel cast-spun piece to 150-160° C.; 5) preserving the heat of the aluminum alloy wheel cast-spun piece for 175-185 minutes at 150-160° C.; and 6) cooling the aluminum alloy wheel cast-spun piece in air to room temperature.

6 Claims, No Drawings

THERMAL TREATMENT METHOD FOR ALUMINUM ALLOY CAST-SPUN WHEEL

CROSS-REFERENCE TO RELATED APPLICATIONS

The present application claims benefit of Chinese Patent Application No. 201710822431.X, filed on Sep. 13, 2017, the contents of which are hereby incorporated by reference in its entirety.

BACKGROUND

At present, automobile wheels are mainly manufactured using aluminum alloy, and cast forming occupies a major position. Casting and spin forming are newly developed molding processes in recent years. In the manufacturing process of an A356 aluminum alloy cast-spun wheel, thermal treatment is an important link, and directly determines the internal structure and mechanical properties of the aluminum alloy wheel. Before the process of the present disclosure appears, there were also thermal treatment processes for casting A356 aluminum alloy cast-spun wheels using A356 aluminum alloy, which cannot achieve optimal mechanical properties on the spun parts of the wheels. Therefore, an optimal combined process is selected by orthogonal tests on solution temperature, solution time, quenching water temperature, quenching time and aging temperature.

SUMMARY

The present disclosure relates to the field of thermal treatment of automobile parts, and specifically, relates to a thermal treatment process for an aluminum alloy cast-spun wheel.

Thus, the objective of the present disclosure is to design a thermal treatment process for an A356 aluminum alloy cast-spun wheel, which can achieve high enough strength, maintain proper plasticity and improve the internal structure, mechanical properties and cutting performance of the aluminum alloy wheel.

In order to achieve the above objective, the present disclosure provides the following technical solution:

In an aspect of the present disclosure, provided is a thermal treatment method for an aluminum alloy cast-spun wheel, including the steps of: 1) heating an aluminum alloy wheel cast-spun blank piece to 540-550° C.; 2) preserving the heat of the aluminum alloy wheel cast-spun piece for 275-285 minutes at the temperature of 540-550° C.; 3) quenching the aluminum alloy wheel cast-spun piece in water of 70-90° C. for at least 180 seconds; 4) heating the aluminum alloy wheel cast-spun piece to 150-160° C.; 5) preserving the heat of the aluminum alloy wheel cast-spun piece for 175-185 minutes at 150-160° C.; and 6) cooling the aluminum alloy wheel cast-spun piece in air to room temperature.

In a preferred aspect of the present disclosure, the heating operation in step 1) is required to ensure uniform heating and ensure that the center, surface and all parts of the wheel reach at least 540° C. and not more than 550° C.

In a preferred aspect of the present disclosure, the heat preservation operation in step 2) is required to ensure that the temperature of the wheel is always within the required upper and lower temperature limits.

In a preferred aspect of the present disclosure, the time for transferring the aluminum alloy wheel cast-spun piece from the heat preservation state to a quenching tank in step 3) is within 20 seconds, and the aluminum alloy wheel cast-spun piece is quenched in the quenching tank of 70-90° C. for 180-240 seconds. By quenching for at least 180 seconds, the surface and the center of the aluminum alloy wheel cast-spun piece are ensured to be quenched thoroughly.

In a preferred aspect of the present disclosure, step 4) is required to ensure uniform heating and ensure that the center, surface and all parts of the wheel are above the required lower limit temperature.

In a preferred aspect of the present disclosure, during heat preservation of step 5), the temperature of the wheel is always within the required upper and lower temperature limits.

In a preferred aspect of the present disclosure, the quenching medium is agitated in step 3).

In a preferred aspect of the present disclosure, the A356 aluminum alloy is an A356.2 aluminum alloy.

In a preferred aspect of the present disclosure, before step 5), the method further includes a step of performing short-time thermal shock on the aluminum alloy wheel cast-spun piece, in which the time of short-time thermal shock is 1-3 minutes, and the temperature is 540-550° C.

In another aspect of the present disclosure, provided is production line equipment for thermal treatment of an aluminum alloy wheel cast-spun piece, including: (1) a solid solution furnace, set to a temperature of 540-550° C.; (2) a water quenching tank, filled with clean water and set to a temperature of 70-90° C.; (3) an aging furnace, set to a temperature of 150-160° C.; and (4) a conveying device for an aluminum alloy wheel, configured to convey the A356 aluminum alloy cast-spun wheel to the solid solution furnace, the water quenching tank and the aging furnace in sequence.

In a preferred aspect of the present disclosure, the water quenching tank includes an agitator.

In a preferred aspect of the present disclosure, the conveying device is configured to preserve the heat for 275-285 minutes in the solid solution furnace after the aluminum alloy wheel reaches 540-550° C. in the solid solution furnace, and remain 180 seconds in the water quenching tank; and preserve the heat for 175-185 minutes in the aging furnace after the temperature of the aluminum alloy wheel reaches 150-160° C. in the aging furnace.

The heterogeneous hypoeutectic structure based on A356 cast-spinning aluminum alloy has the characteristics: coarse eutectic structures exist around solid solution grains of as-cast A356 cast-spun aluminum alloy; and the solid solution phase in the solid solution is not uniform in concentration and has second phase mass points. After spinning deformation processing on the A356 cast aluminum alloy wheel, the grains are elongated and the state of eutectic silicon also changes. The solubility of Si or intermetallic compound of the A356 cast-spinning aluminum alloy in the a solid solution decreases with the decrease of temperature, the A356 aluminum alloy cast-spun wheel is heated to a high temperature as possible and kept at this temperature for a long enough time, the strengthening phase is fully dissolved into the a solid solution, the strengthening phase reaches the maximum solubility in the a solid solution and then is rapidly cooled, and the high-temperature solid solution is supersaturated to room temperature; the supersaturated solid solution is metastable and is decomposed and diffused with the increase of the standing time, and if the temperature is higher, the decomposition and diffusion rates are larger; for the need of continuous production, the A356 aluminum alloy cast-spun wheel is heated to a certain temperature to accelerate the decomposition and diffusion of the supersaturated solid solution, and kept for a period of time, so that the crystal lattice structure of the A356 cast-spinning aluminum alloy is restored to a relatively stable state, the structure state of the A356 cast-spun aluminum alloy is changed, and the purpose of improving mechanical properties is achieved.

The present disclosure also provides the following technical solution:

Uniform heating is ensured in 1), so that the center, surface and all parts of the wheel are above the required lower limit temperature; in the heat preservation process 2), the temperature of the wheel is always within the required upper and lower temperature limits, in order to achieve this purpose, the thermal treatment equipment is equipped with a temperature control thermocouple and an over-temperature thermocouple, and at the same time, air supply and air guide systems are provided in the furnace to ensure uniform temperature inside the furnace; in the quenching process 3), the wheel is transferred from the solid solution furnace to the quenching tank within 20 seconds, and the temperature of the wheel will not fall to precipitate the solid solution phase during the transfer process; uniform heating is ensured in 4), so that the center, surface and all parts of the wheel are above the required lower limit temperature; in the heat preservation process 5), the temperature of the wheel is always within the required upper and lower temperature limits, in order to achieve this purpose, the thermal treatment equipment is equipped with a temperature control thermocouple and an over-temperature thermocouple, and at the same time, air supply and air guide systems are provided in the furnace to ensure uniform temperature inside the furnace.

The inventors also carried out a lot of contrast experiments. The contrast experiments show that in step 2), if the temperature of the solid solution is higher and closer to a eutectic transition temperature or a solid phase line temperature, the quenching effect is better, but if the temperature of the furnace is not well controlled, the risk of over-burning will increase; and the heat preservation time of the solid solution depends on the time required for dissolving the strengthening phase into the a solid solution. In step 5), if the aging temperature is higher and the time is longer, the strength and the hardness are higher, but the plasticity will decrease; if the aging temperature is lower and the time is shorter, the strength and the hardness are lower, but the plasticity will increase; and the required mechanical properties can be obtained by preserving the heat at a high temperature for a short time or at a low temperature for a long time, which is required to find a best combination of temperature and time by orthogonal test. In step 3), the quenching medium that is water is agitated, which can increase the uniformity of the water temperature, increase the cooling rate of the wheel and improve the solid solution effect.

According to the method and the production line equipment of the present disclosure, the aluminum alloy wheel cast-spun piece after thermal treatment has excellent tensile strength, yield strength, elongation and hardness by orthogonal test optimization design; and the method is superior to other methods adopted at present in the art in the improvement on mechanical properties.

DETAILED DESCRIPTION

Embodiment 1

The blank of the hub is produced using a low pressure casting method, the rim and the inner edge are machined by spinning, and then the hub is thermally treated in accordance with the method of this embodiment. The specific method used is as follows: 1) heating an aluminum alloy wheel cast-spun piece to 540-550° C.; 2) preserving the heat of the aluminum alloy wheel cast-spun piece for 280 minutes at the temperature of 540-550° C.; 3) quenching the aluminum alloy wheel cast-spun piece in water of 70-90° C. for 180 seconds; 4) heating the aluminum alloy wheel cast-spun piece to 150-160° C.; 5) preserving the heat of the aluminum alloy wheel cast-spun piece for 180 minutes at 150-160° C.; and 6) cooling the aluminum alloy wheel cast-spun piece in air to room temperature. The quenching medium that is water in step 3) is agitated so that the temperature thereof is as uniform as possible. The temperature range referred in the method of this embodiment means that the temperatures of temperature sensors distributed throughout are within the indicated temperature range. During the setup process, it is not possible to have the same temperature at all locations, but instead have a temperature distribution range.

After thermal treatment, 1000 hubs were produced in test workshops of CITIC Dicastal Co., Ltd. The mechanical properties of the hubs are shown in Table 1.

TABLE 1

Mechanical properties of hubs in Embodiment 1:

| Sampling point | Tensile strength Rm (MPa) | Yield strength Rp0.2 (MPa) | Elongation A5 (%) | Hardness HBW10/500 |
|---|---|---|---|---|
| Inner wheel flange | ≥260 MPa | ≥180 MPa | ≥11% | ≥80 |

The produced hubs meet the design requirements of the customer company and have been well received by customers.

Embodiment 2

The blank of the hub is produced using a low pressure casting method, the rim and the inner wheel flange are spun and then the hub is thermally treated in accordance with the method of the present disclosure. The specific method used is as follows: 1) heating an aluminum alloy wheel cast-spun piece to 540-550° C.; 2) preserving the heat of the aluminum alloy wheel cast-spun piece for 280 minutes at the temperature of 540-550° C.; 3) quenching the aluminum alloy wheel cast-spun piece in water of 70-90° C. for 180 seconds; 4) heating the aluminum alloy wheel cast-spun piece to 150-160° C.; 5) preserving the heat of the aluminum alloy wheel cast-spun piece for 180 minutes at 150-160° C.; and 6) cooling the aluminum alloy wheel cast-spun piece in air to room temperature. The quenching medium that is water in step 3) is agitated so that the temperature thereof is as uniform as possible. The temperature range referred in the method of this embodiment means that the temperatures of temperature sensors are within the indicated temperature range. During the setup process of the solid solution furnace, it is not possible to have the same temperature at all locations, but instead have a temperature distribution range.

After thermal treatment, 1000 hubs were produced in test workshops of CITIC Dicastal Co., Ltd. The mechanical properties of the hubs are shown in Table 2.

TABLE 2

| Mechanical properties of hubs in Embodiment 2: | | | | |
|---|---|---|---|---|
| Sampling point | Tensile strength Rm (MPa) | Yield strength Rp0.2 (MPa) | Elongation A5 (%) | Hardness HBW10/500 |
| Inner wheel flange | ≥260 MPa | ≥180 MPa | ≥11% | ≥80 |

The produced hubs meet the design requirements of the customer company and have been well received by customers.

Embodiment 3

This embodiment is substantially the same as embodiment 1 in conditions, and the difference is, before step 5), the method further includes a step of performing short-time thermal shock on the aluminum alloy wheel cast-spun piece, in which the time of short-time thermal shock is 3 minutes, and the temperature is 540° C.

After thermal treatment, 1000 hubs were produced in test workshops of CITIC Dicastal Co., Ltd. The mechanical properties of the hubs are shown in Table 3.

TABLE 3

| Mechanical properties of hubs in Embodiment 3: | | | | |
|---|---|---|---|---|
| Sampling Point | Tensile strength Rm (MPa) | Yield strength Rp0.2 (MPa) | Elongation A5 (%) | Hardness HBW10/500 |
| Inner wheel flange | ≥285 MPa | ≥210 MPa | ≥10.4% | ≥80 |

Embodiment 4

This embodiment is substantially the same as embodiment 2 in conditions, and the difference is, before step 5), the method further includes a step of performing short-time thermal shock on the aluminum alloy wheel cast-spun piece, in which the time of short-time thermal shock is 1 minute, and the temperature is 550° C.

After thermal treatment, 1000 hubs were produced in test workshops of CITIC Dicastal Co., Ltd. The mechanical properties of the hubs are shown in Table 4.

TABLE 4

| Mechanical properties of hubs in Embodiment 4: | | | | |
|---|---|---|---|---|
| Sampling Point | Tensile strength Rm (MPa) | Yield strength Rp0.2 (MPa) | Elongation A5 (%) | Hardness HBW10/500 |
| Inner wheel flange | ≥287 MPa | ≥212 MPa | ≥10.1% | ≥80 |

The invention claimed is:

1. A thermal treatment method for an aluminum alloy wheel produced by casting and spinning, comprising the steps of:

1) heating the aluminum alloy wheel produced by casting and spinning to 540-550° C.;
2) preserving the heat of the aluminum alloy wheel produced by casting and spinning for 275-285 minutes 540-550° C.;
3) quenching the aluminum alloy wheel produced by casting and spinning in 70-90° C. water for 180 seconds;
4) heating the aluminum alloy wheel produced by casting and spinning to 150-160° C.;
5) preserving the heat of the aluminum alloy wheel produced by casting and spinning for 175-185 minutes at 150-160° C.; and
6) cooling the aluminum alloy wheel produced by casting and spinning in air to room temperature.

2. The thermal treatment method for the aluminum alloy wheel produced by casting and spinning according to claim 1, wherein uniform heating is ensured in step 1).

3. The method according to claim 1, wherein a time for transferring the aluminum alloy wheel produced by casting and spinning from a heat preservation state to a quenching tank in step 3) is within 20 seconds.

4. The thermal treatment method for the aluminum alloy wheel produced by casting and spinning according to claim 1, wherein uniform heating is ensured in step 4).

5. The thermal treatment method for the aluminum alloy wheel produced by casting and spinning according to claim 1, wherein before step 5), the thermal treatment method for the aluminum alloy wheel produced by casting and spinning further comprises a step of performing short-time thermal shock on the aluminum alloy wheel produced by casting and spinning, wherein a time for the short-time thermal shock is 1-3 minutes, and a temperature for the short-time thermal shock is 540-550° C.

6. The thermal treatment method for the aluminum alloy wheel produced by casting and spinning according to claim 1, wherein a quenching medium is agitated in step 3).

* * * * *